United States Patent [19]

Bolejack et al.

[11] Patent Number: 5,046,302

[45] Date of Patent: Sep. 10, 1991

[54] METHOD AND APPARATUS FOR BAGGING PRODUCT UNITS

[75] Inventors: Kevin J. Bolejack; Frederick Forgnone, both of Salinas, Calif.

[73] Assignee: Transfresh Corporation, Salinas, Calif.

[21] Appl. No.: 311,225

[22] Filed: Feb. 15, 1989

[51] Int. Cl.[5] ..... B65B 41/00; B65B 43/50

[52] U.S. Cl. ..... 53/459; 53/390; 53/468

[58] Field of Search ..... 53/459, 469, 467, 468, 53/219, 218, 391, 390, 392

[56] References Cited

U.S. PATENT DOCUMENTS

| | | | |
|---|---|---|---|
| 3,473,290 | 10/1969 | Culpepper | 53/392 X |
| 3,584,428 | 6/1971 | Falk | 53/391 X |
| 3,648,433 | 3/1972 | Owen | 53/390 X |
| 3,852,937 | 12/1974 | Bitsura et al. | 53/386 X |
| 4,055,931 | 11/1977 | Myers | 53/408 |
| 4,546,598 | 10/1985 | Karpisek | 53/390 X |
| 4,821,489 | 4/1989 | MacLeod et al. | 53/419 |

FOREIGN PATENT DOCUMENTS 2132971 1/1972 Fed. Rep. of Germany .

*Primary Examiner*—James F. Coan

[57] ABSTRACT

A method and apparatus are disclosed for sealing pallets of fresh produce inside plastic bags and furnishing the interiors of the sealed bags with a modified gaseous atmosphere. Conventional pallets loaded with cooled fresh produce are moved by an input conveyor automatically one at a time to an in-line squeeze station. The produce load of a pallet positioned at the squeeze station is squeezed between opposed vertical walls to suspend it above the pallet base as a downwardly movable floorplate descends to allow the base to the removed and replaced with a pallet having a plastic sheet lining attached thereto. The floorplate is raised to its former level to bear the weight of the loaded pallet as the pallet is unsqueezed and the loaded pallet is moved by conveyor to a bagging station. A plastic bag at a convenient height is initially draped over an arm radiating from a novel bagger frame. A plurality of such arms extend from a rotatable hub so that bags can be moved into position above successive loaded pallets as they are needed. This apparatus permits the bagging of nearly twice as many pallets in a given time period. Following the bagging step the bagged pallet is moved to a turntable and sealed by rotation against spring-loaded overlapping strips of tape. After being moved automatically to a gassing station, the sealed bag is first evacuated and then filled with a suitably modified gaseous atmosphere using a Tectrol Atmosphere Injection Unit. The gassed pallet is reoriented through 90° by a repositioning turntable and sent down an inclined roller-surfaced table to a pallet exit area. In addition to allowing the processing of more units in less time than is possible with present systems, the method and apparatus of the invention require fewer workers to effect the improved results.

4 Claims, 5 Drawing Sheets

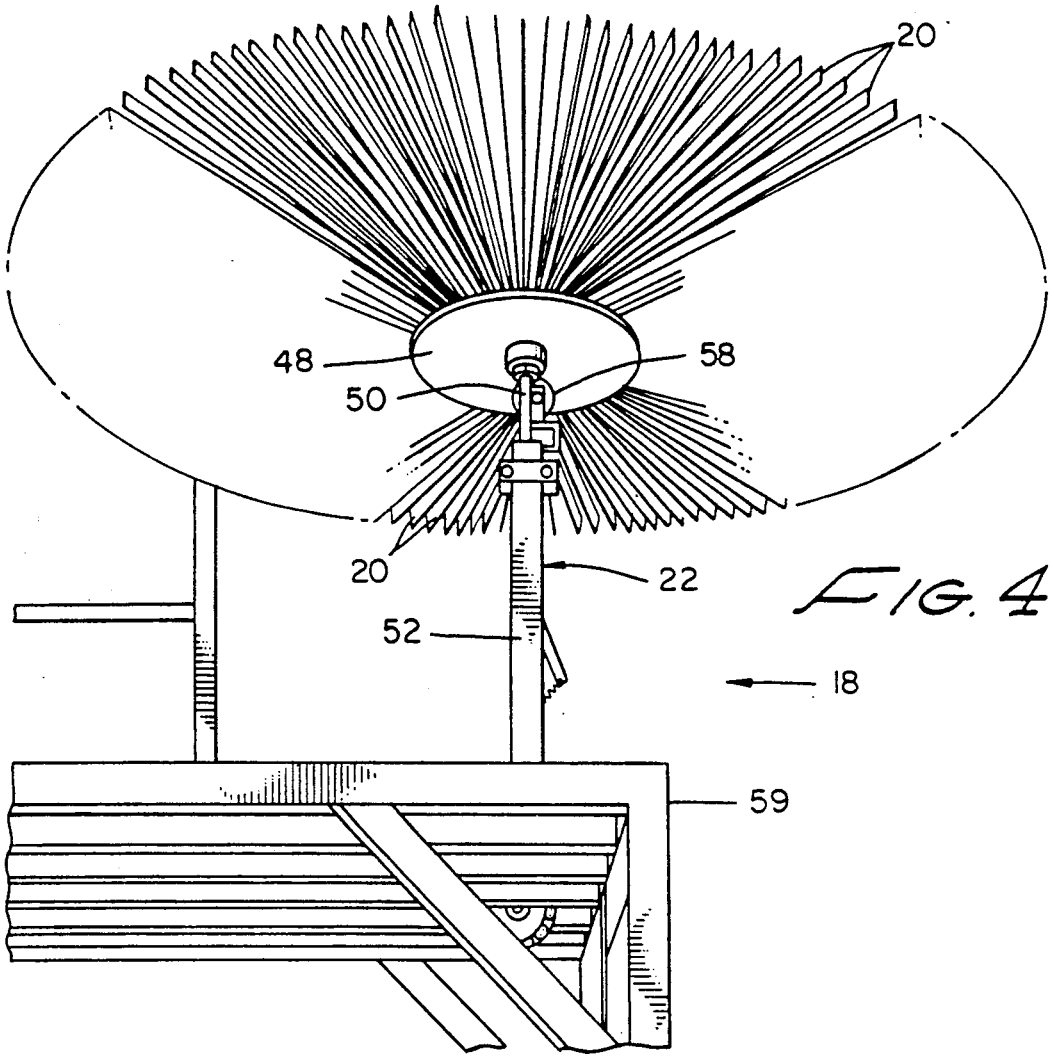
FIG. 4
FIG. 6
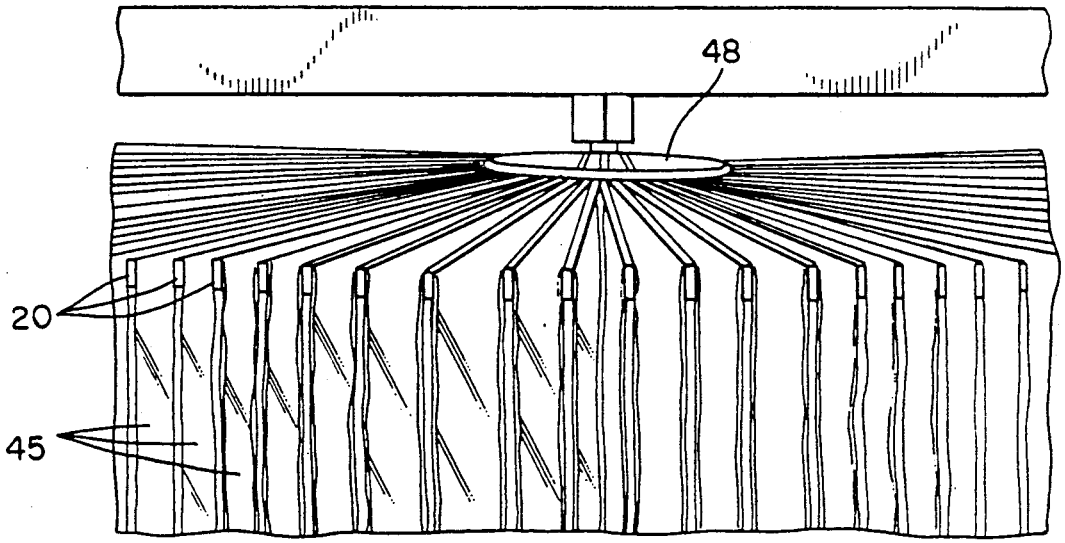

METHOD AND APPARATUS FOR BAGGING PRODUCT UNITS

BACKGROUND OF THE INVENTION

1. Field of the Invention

The invention relates to the field of bagging product units on a production line, and in particular to a method and apparatus for bagging agricultural produce pallets in preparation for modifying the atmosphere surrounding the produce inside the bag with a gas or gas mixture to retard ripening and spoilage, or to otherwise promote freshness and extend the shelf life of such produce.

2. Description of the Related Art

The ripening of agricultural produce such as tomatoes or peaches is affected by the atmosphere surrounding the produce. Many foodstuffs, such as fresh produce (e.g., strawberries, lettuce, tomatoes, cauliflower), can have their fresh condition maintained for an extended period of time by controlling the gaseous atmosphere inside the package in which they are contained. Losses during shipment and storage can be substantially decreased in this manner so that a greater percentage of fresh produce can be delivered to the consumer in acceptable condition.

Many kinds of fresh produce, a primary one being strawberries, are shipped in a quantity of boxes on a pallet base, with the entire load being enclosed by a plastic bag that is sealed to the base. U.S. Pat. No. 4,055,931, which is hereby incorporated herein by reference, discloses the providing of a special atmosphere into the containing space formed by the plastic bag by first inserting a sharp-ended nozzle through the plastic sheeting, evacuating the air inside the bag, and introducing gases into the interior, U.S. patent application Ser. No. 06/428,087, filed Sept. 29, 1982, entitled "Method and Apparatus for Sealing a Flexible Bag to a Pallet," by Richard F. MacLeod and Kevin J. Bolejack, assigned to the assignee of the present application, is hereby also incorporated herein by reference. It discloses a method and apparatus described briefly as follows. Produce is stacked in one or more boxes onto a pallet base having an oversized, gasproof plastic sheeting integrally related to the pallet base upper surface. The loaded pallet is placed on a rotatable table having a generally horizontal upper surface and a plastic bag is lowered over the produce which has its lower edges located to extend partway down over the turned portions of the plastic sheeting and onto the rim of the pallet base. Two rolls of tape are mounted at different heights on vertical spindles closely adjacent the rotating table and are located so that when the tape is pulled off the spindles, the two tape strips will have an edge portion in overlapping relationship with each other. An idler roller engages the two strips of tape at two different predetermined angles joining them together in a single composite tape strip. The composite tape strip is applied by a pressure roller along the lower edge of the plastic bag and the upturned plastic sheeting edge. After a full revolution of the table is completed, the tape is cut and the bag is completely sealed to the plastic sheeting. A lever arm on the pressure roller is spring-loaded so as to maintain the tape compressingly contacting the plastic bag and pallet throughout the full range of table rotation. Once the bag has been sealed, a sharp-ended nozzle punctures the bag, the bag is evacuated to remove residual air, and a prescribed pressurized gas is injected into the bag. The nozzle is then removed and the opening in the bag is taped closed.

The present approach taken in that part of the process involving securing the plastic bag over the produce and onto the pallet base has been found to be deficient in certain respects. Considerable floor space and worktime are needed in the step of slipping a plastic bag over a pallet and fastening its edges to the plastic sheeting of the pallet base. A bag must first be prepared for slipping over the pallet by expanding it to an open shape into which the pallet can enter as the bag is pulled downward over it. This is done by walking the bag around the room to fill it with air before it can be slipped over the top of the loaded pallet, and requires an appropriate amount of floor space. Two workers are required to manipulate the bag in opening it up, placing it with its opening facing downward above the top of the pallet, sliding it downward over the full height of the pallet, and smoothing and arranging the free edges of the bag in relation to the plastic pallet sheeting preparatory to the taping and sealing carried out in the next stage of the process. Using the present system about 15 pallets can be bagged, gassed, and sealed in roughly 45 minutes utilizing at least ten workers. It would be an advance in the art of produce preservation and packaging if the amount of space required for the operation, the number of personnel needed, and the time it takes could all be reduced.

SUMMARY OF THE INVENTION

A method and apparatus are disclosed for enclosing pallets of fresh produce in sealed bags and furnishing the interiors of the sealed bags with a modified gaseous atmosphere for preserving such produce. Conventional pallets loaded with fresh produce are transported from cooling tunnels to an input conveyor. The input conveyor moves the pallets automatically one at a time to an in-line squeeze station. When a pallet is positioned on the squeeze station the conveyor stops automatically. The produce load of a pallet positioned at the squeeze station is squeezed between opposed vertical walls to suspend it above the pallet base as a downwardly movable floorplate descends to allow the base to be removed and replaced with a pallet having a plastic sheet lining attached thereto. Then the floorplate is raised to its former level to bear the weight of the loaded pallet as the pallet is unsqueezed. Next the loaded pallet with its plastic-covered base is moved by conveyor to a bagging station. The free edges of the plastic sheeting are folded upward and attached to the trays on the first tier of the pallet, and the mouth of a plastic bag is drawn downward over the top of the loaded pallet. The bag is initially draped over an arm radiating from a bagger frame which keeps a supply of bags draped over a plurality of such radial arms at a convenient height. The arms extend from a rotatable hub so that bags can be moved into position above successive loaded pallets as they are needed. This apparatus permits the bagging of nearly twice as many pallets as before in a given time period. Following the bagging step the bagged pallet is moved to a turntable and sealed by rotation against spring-loaded overlapping strips of tape. After being moved, preferably automatically, to a gassing station, the sealed bag surrounding the produce is first evacuated and then filled with a suitably modified atmosphere to preserve the freshness of the produce. A preferred method for bag evacuation and subsequent gas filling in the Tectrol Atmosphere Injection System employs the insertion of nozzle means through the plastic bag. Gases inside the bag are first removed with vacuum means and then replaced with a spoilage-retardant modified gaseous atmosphere. The hole punctured in the bag by the inserted nozzle is sealed, preferably with a patch of tape. The gassed pallet is reoriented through 90° by a repositioning turntable and sent down an inclined portion of roller-surface table to a pallet exit area for removal, preferably by forklift. In addition to allowing the processing of more units in a given time period than is possible with present systems, the method and apparatus of the invention require fewer workers to effect the improved results.

BRIEF DESCRIPTION OF THE DRAWINGS

The various features and advantages of the present invention will become apparent in light of the following detailed description taken together with the accompanying drawings, in which:

FIG. 4 is a perspective view from below of the pallet bagger apparatus without bags;

FIG. 6 is a fragmentary perspective view of the pallet bagger; and

DESCRIPTION OF THE PREFERRED EMBODIMENTS

The method and apparatus of the present invention will be described in terms of pallets loaded with strawberries, although only minor modifications in the sizing of the apparatus is necessary for application to other types of produce. A plurality of strawberry packages are initially stacked onto the upper surface of a pallet constructed of wood and comprising five slats on three runners. A fully loaded pallet contains 16 tiers of 6 trays in each tier and has an overall height of about 88 inches. Each tray contains 12 one-pint baskets of strawberries, so that a fully loaded pallet has 96 dozen pint baskets of strawberries. A strawberry pallet is 39 inches by 39 inches, whereas all other produce pallets are 40 inches by 48 inches. Eight loaded pallets are accommodated in a cooling tunnel at one time where the strawberries are cooled to around 33° F., which is about 4° above the freezing point of the strawberries depending on their sugar content. The gassing operation is only done on cold produce.

Figure 1:
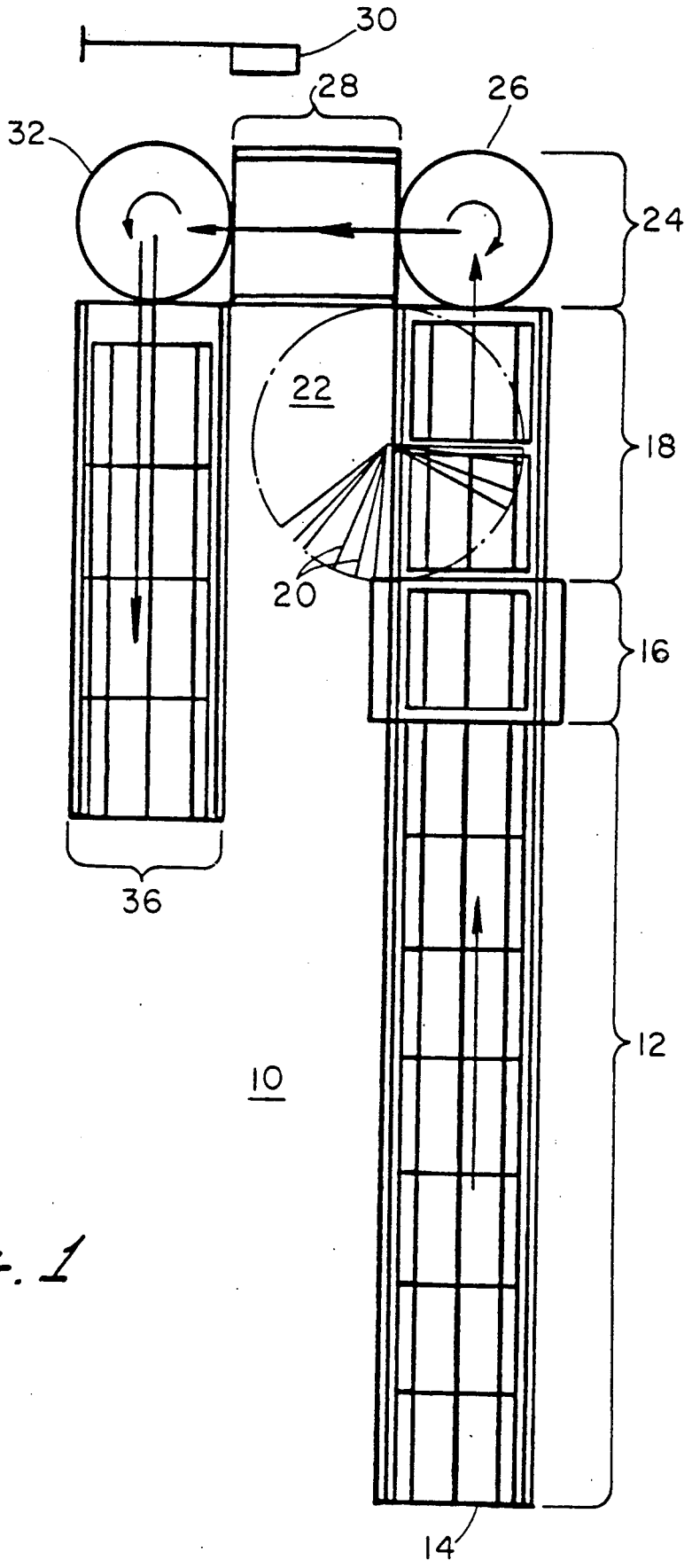
FIG. 1 is a schematic plan view of the layout of the pallet bagging and sealing system.

FIG. 1 is a schematic plan view of the layout of the bagging apparatus 10 of the invention. An infeed portion 12 of apparatus 10 comprises a conveyor line using metal rollers which are actuated by a belt drive. Eight pallets are brought by forklift from a cooling tunnel and unloaded at infeed 14 of the conveyor line. When the first loaded pallet reaches a pallet squeeze station 16 the drive mechanism for the conveyor line is automatically shut off. Pallet squeeze station 16 comprises a hydraulically actuated pair of opposed vertical walls above a pneumatically actuated floorplate. An operator manually activates the hydraulically actuated vertical walls, one of which approaches the other by a distance calculated to squeeze the pallet load a sufficient amount to support it against the force of gravity. The floorplate on which the loaded pallet normally rests is pneumatically moved downward to allow removal of the conventional wooden pallet base and replacement of it with a pallet which has a generally rectangular plastic sheet that underlies the pallet top layer and is thus incorporated into the pallet construction. The sheet is generally flat and its edge margins are formed upwardly into a generally tray or open pan shape. The floorplate is then raised to its original position to support the pallet load, the pallet load is unsqueezed, and the loaded Tectrol pallet is moved to pallet bagging station 18.

Pallet bagging station 18 comprises a work area which will accommodate two loaded pallets, above which, at a convenient height, are rotatable arm-like extensions 20 which form part of a pallet bagger frame 22. A plurality of plastic bags are folded or draped over extensions 20 so that the bag openings are at a height just greater than the top of a loaded pallet. Two workers are employed at pallet bagging station 18 in bagging the loaded pallets after the pallets have left pallet squeeze station 16. The upwardly formed edge margins of the plastic sheet on each pallet are stapled to the trays on the first tier of the pallet load in preparation for the bagging step. Bagging is done by pulling the opening of a bag lying draped on one of the extensions 20 over the top of the pallet load and downward to the base of the pallet. The free edges of the bag are made to overlap the stapled edges of the plastic sheet of the pallet base.

A bagged pallet prepared in this manner is then moved by conveyor rollers to a rotary tape sealing station 24, where the overlapping margins of the bag and the plastic sheet are sealed with tape. Rotary tape sealing station 24 comprises a turntable 26 on which the pallet is held against tape as turntable 26 rotates to seal the bag to the plastic sheet of the pallet base. After sealing is effected, the bagged pallet is transferred to gassing area 28 where a nozzle from an MA350 Tectrol Atmosphere Injection Unit 30 is inserted through a bag wall into the interior. First the interior gases in the sealed bag are evacuated through the nozzle forming a partial vacuum within the bag, and then a prescribed gas is injected or drawn into the bag by partial vacuum. The nozzle is then withdrawn and the opening in the bag is closed with a patch of tape. Finally the bagged, sealed, and gassed pallet is transferred to repositioning turntable 32, rotated through 90°, and sent down an inclined table 34 with rollers to be stopped at off-feed area 36.

Figure 2:
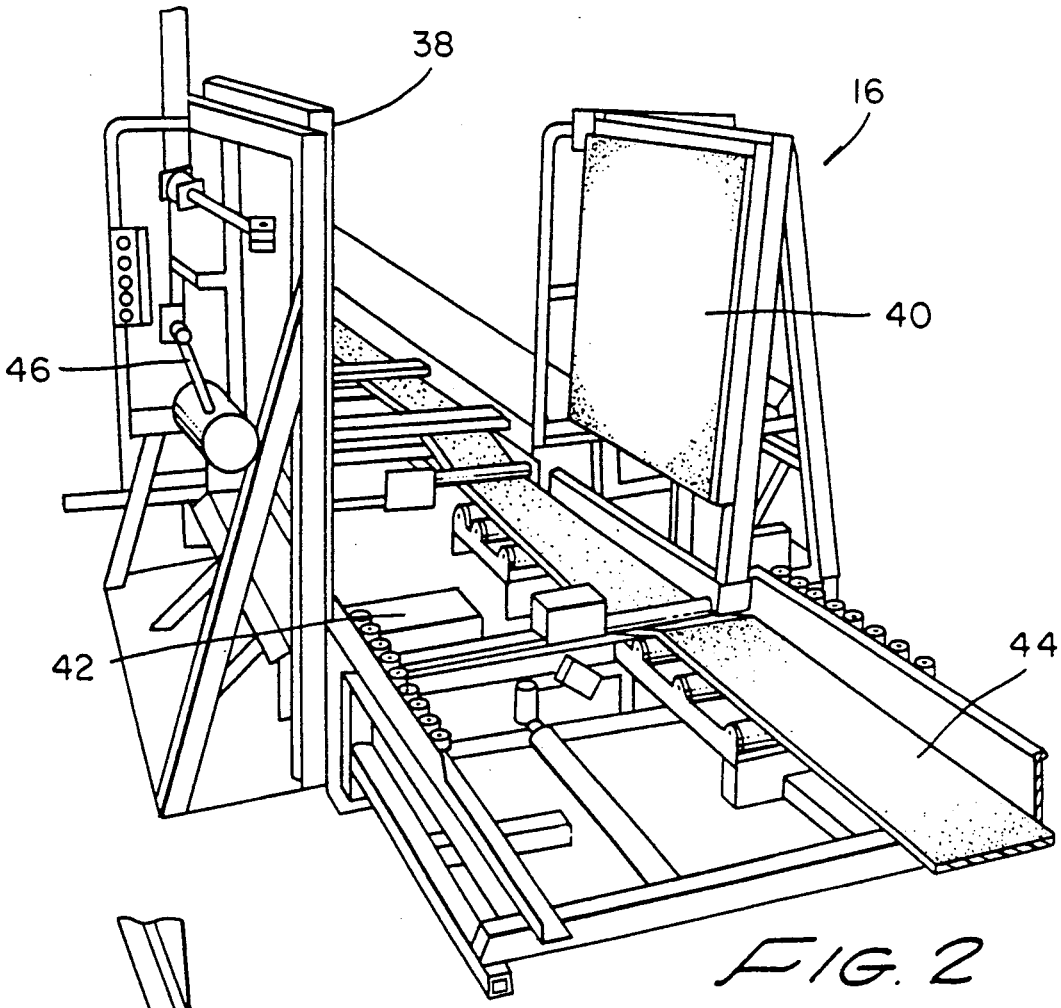
FIG. 2 is a perspective view of the apparatus of the squeeze station.
Figure 3:
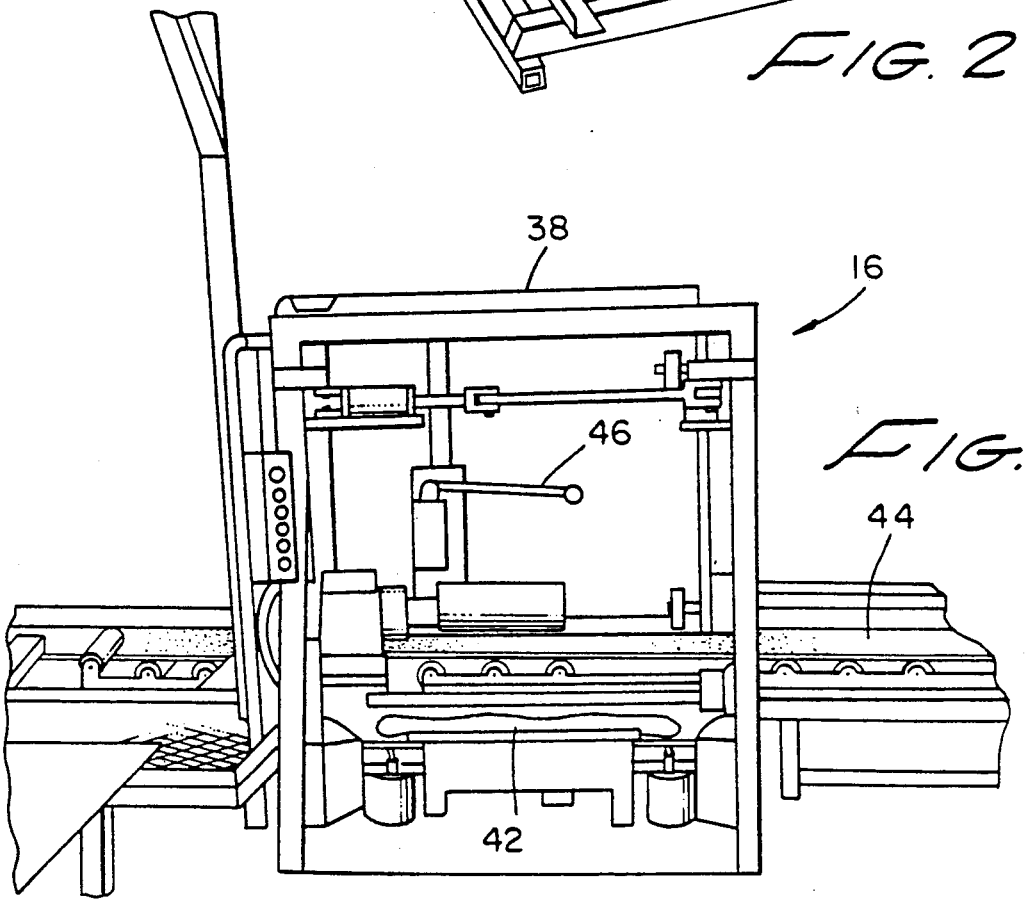
FIG. 3 is a side view of the apparatus of the squeeze station.

Referring to FIG. 2, which is a perspective view of the apparatus of squeeze station 16, certain details of the apparatus may be seen. Hydraulically actuated opposed vertical walls 38 and 40 flank a space above pneumatically actuated floorplate 42. When floorplate 42 is in its raised position the loaded pallet is brought into the space on conveyor belt 44. Wall 40 is moved hydraulically toward wall 38 to squeeze the pallet load a sufficient amount to support it against the force of gravity. The operator manually activates the hydraulically actuated vertical walls 38 and 40 by turning lever 46. Lever 46 is shown more clearly in FIG. 3, which is a side view of the apparatus of the squeeze station 16.

Floorplate or deckplate 42, on which the loaded pallet normally rests, is pneumatically moved downward to allow the conventional wooden pallet base to be removed and replaced with a pallet which has a plastic sheet underlying the pallet top layer and integrally incorporated into the pallet construction. Floorplate 42 is then raised in its original position to support the pallet load, the pallet load is unsqueezed, and the loaded plastic-covered pallet is moved on conveyor belt 44 to pallet bagging station 18.

Figure 5:
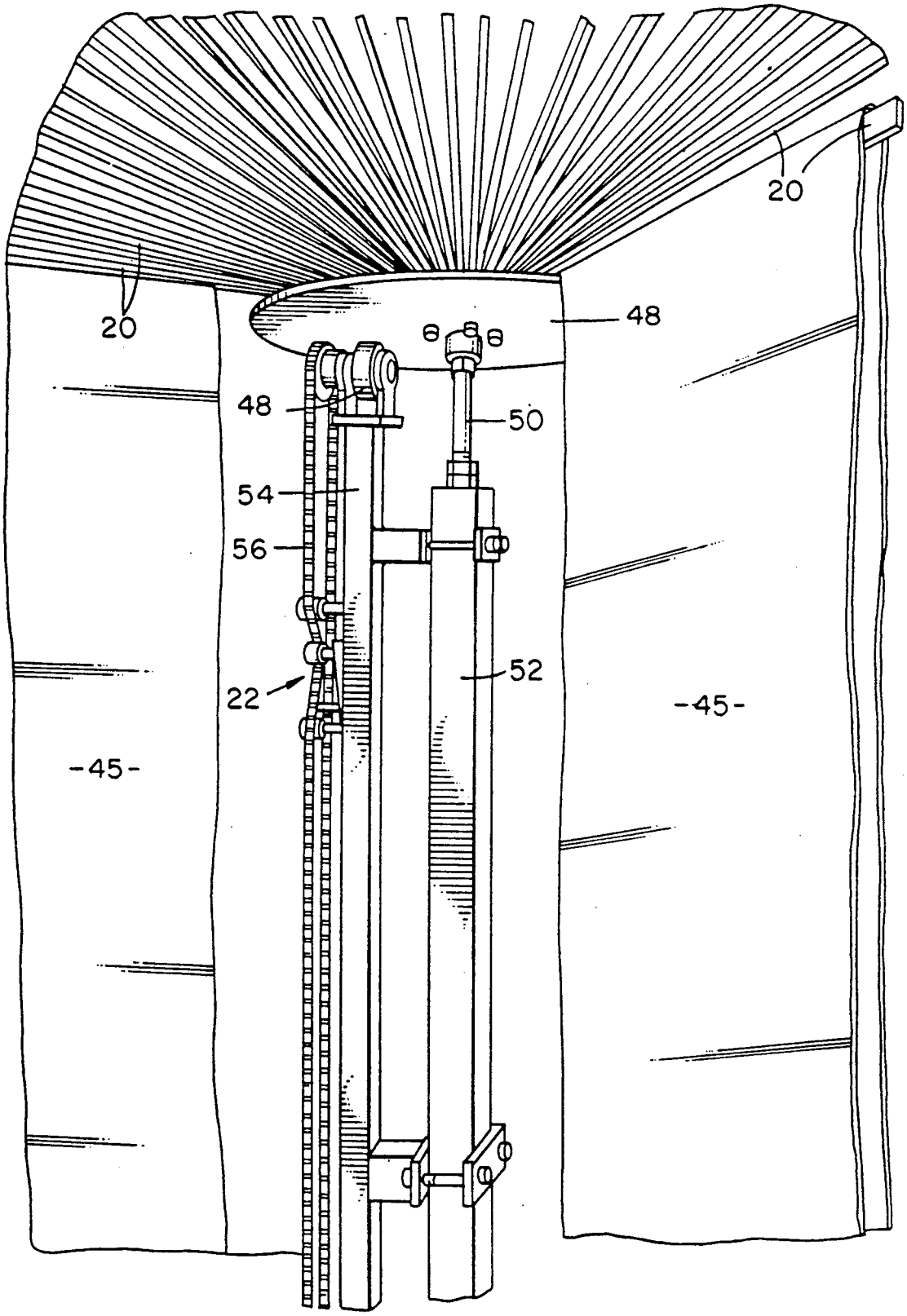
FIG. 5 is a side perspective view of the pallet bagger apparatus with bags folded over and hanging from some of the arms.

FIG. 4 is a perspective view from below of part of pallet bagging station 18, namely the pallet bagger frame 22 with its arm-like extensions 20 over which a plurality of plastic bags 45 are folded or draped. FIG. 5 is a side perspective view of the pallet bagger frame 22 with bags 45 folded over and hanging from some of the arms. Each bag 45 is draped over an extension 20 so that half of the bag 45 hangs to each side. Extensions 20 radiate from a hub 48 on the end of a central rotatable shaft 50 which turns in a bearing mounted inside post 52. A drive arrangement mounted on a vertical frame member 54 parallel to post 52 includes a chain drive 56 which rotates a rubber wheel 58 in frictional contact with the underside of hub 48. The lower end of chain drive 56 (not shown) is accessible to an operator standing underneath frame 22 so that hub 48 can be rotated by hand to bring fresh bags 45 into place over the work area of pallet bagging station 18 as successive loaded pallets are bagged. In an alternative arrangement the incremental rotation of hub 48 could be effect by any one of a number of automatic drive arrangement which are known in the art, such as through the use of a stepping motor to drive chain drive 56. Details of how the bags 45 are folded over the radial arms 20 of the bagger frame 22 are shown in FIG. 6, which is a fragmentary perspective view of the pallet bagger apparatus.

The plurality of arm-like extensions 20 numbers about 200. The extensions 20 are loaded up with bags 45 before a bagging session begins by a worker who mounts a platform 59 (shown in FIG. 4) permitting access to extensions 20. The bags 45 lie draped over extensions 20 with their openings just above the level corresponding to the top of the loaded pallets.

Figure 7:
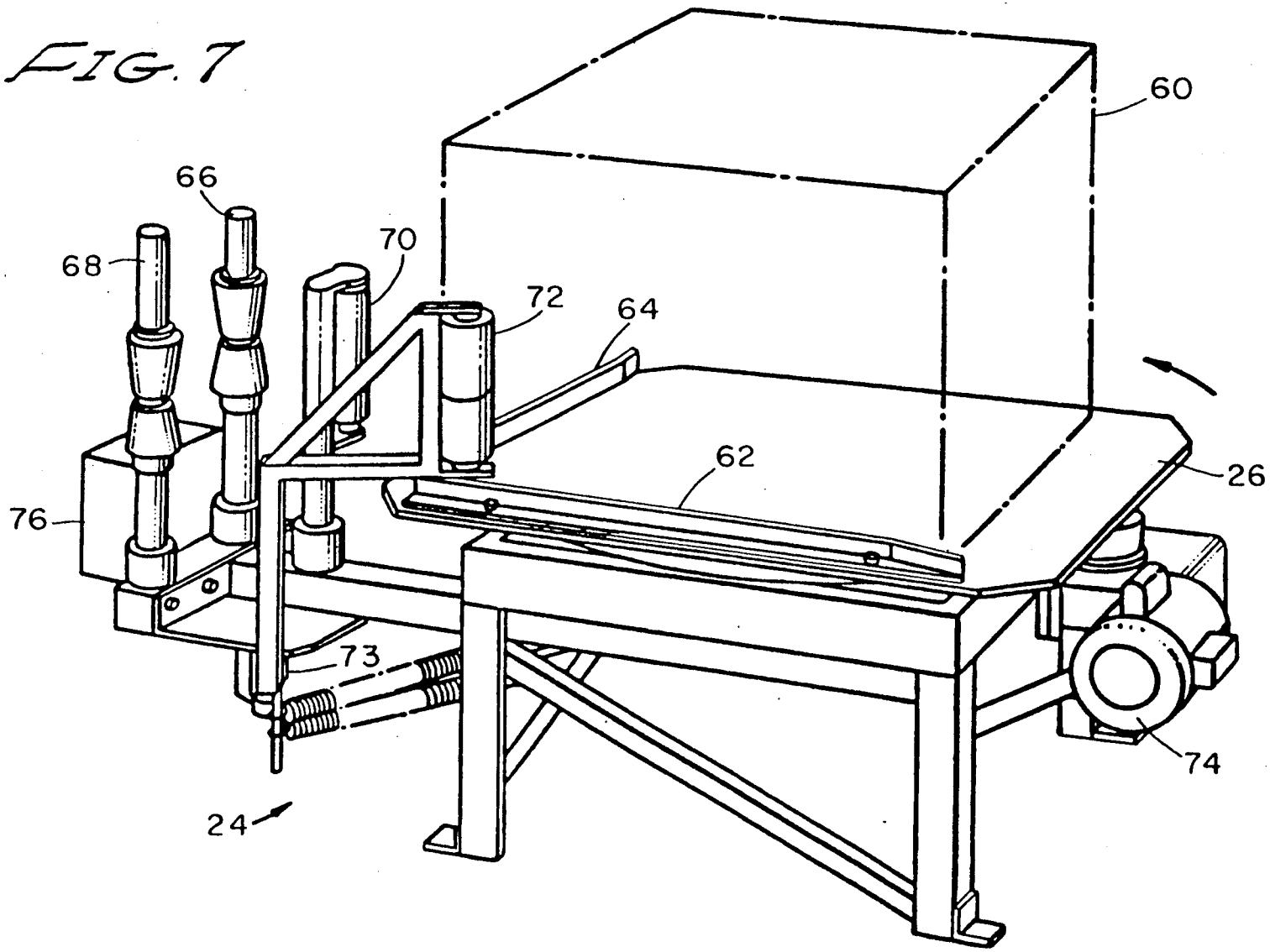
FIG. 7 is a perspective view of the apparatus of the taping and sealing station.

FIG. 7 is a perspective view of the apparatus of the taping and sealing station, which is described in detail in U.S. patent application Ser. No. 06/428,087, filed Sept. 29, 1982, entitled "Method and Apparatus for Sealing a Flexible Bag to a Pallet," referred to above. Briefly, referring to FIG. 7, the loaded pallet 60 is conveyed after being bagged to sealing apparatus 24 and located on turntable 26, the pallet side edges being approximately squared with the upstanding walls 62 and 64. Turntable 26 has a generally horizontal upper surface. A composite tape strip is pulled by hand toward the container 60 and affixed by hand to the container adjacent a corner and positioned vertically so as to cover both the upper edge of the plastic sheet and the outer edges of the plastic sheeting that forms part of the pallet. Two rolls of tape are mounted at different heights on vertical spindles 66 and 68 closely adjacent rotating table 26 and are located so that when the tape is pulled off the spindles 66 and 68, the two tape strips will have an edge portion in overlapping relationship with each other. An idler roller 70 engages the two strips of tape at two different predetermined angles joining them together in a single composite tape strip. The composite tape strip is applied by a pressure roller 72 along the lower edge of the plastic bag and the upturned plastic sheeting edge. After a full revolution of turntable 26 is completed, the tape is cut and the bag is completely sealed to the plastic sheeting. A lever arm 73 on the pressure roller is spring-loaded so as to maintain the tape compressingly contacting the plastic bag and pallet throughout the full range of table rotation. A power source 74 is energized by actuating switch 76 and the turntable 26 driven for at least one full revolution, during which time tape is pulled off the two rolls on 66 and 68 and pressed as a composite tape onto the container 60 by continuous pressure from pressure roller 72. At the completion of taping, the rotational drive ceases by automatic or manual control and the tape is cut.

The above-described embodiments are furnished as illustrative of the principles of the invention, and are not intended to define the only embodiments possible in accordance with our teaching. Rather, the invention is to be considered as encompassing not only the specific embodiments shown, but also any others falling within the scope of the following claims.

What is claimed is:

1. In a method for bagging a succession of product units, moving one said unit into a first predetermined position underneath a frame from which bags depend, said frame comprising an automatically rotatable hub at the upper end of a vertical member with a plurality of arms extending horizontally and radially outward from said vertical member, rotating said hub automatically to position one of said arms having a bag depending therefrom above said first predetermined position each time a unit is moved to said first predetermined position, placing an opening of said bag around a top of said unit and enclosing said unit with said bag, moving said enclosed unit to a second predetermined position, and sealing said bag closed with said unit inside.

2. An apparatus for bagging a succession of product units comprising:

means for moving one unit at a time into a first predetermined position; and a frame with a plurality of rotatable radial arms for the suspension of bags above a product unit in said first predetermined position, said frame comprising means for automatically rotating said arm to said first predetermined position.

3. In a method for bagging a succession of product units, moving one said unit into a first predetermined position underneath the frame comprising a vertical member with a plurality of arms extending horizontally and radially outward from said vertical member, and with each of said arms being independently rotatable with respect to the vertical axis of said vertical member, automatically rotating one of said arms with a bag depending from one of said arms to a location above said first predetermined position each time a unit is moved into said first predetermined position, placing an opening of said bag around the top of said unit and enclosing said unit with said bag, moving said enclosed unit to a second predetermined position, and sealing said bag closed with said unit inside.

4. An apparatus for bagging a succession of product units comprising means for moving one unit at a time to a first predetermined position, and a frame including a rotatable hub at the upper end of a vertical member with a plurality of arms extending horizontally and radially outward from said vertical member, each of said rotatable radial arms being adapted for the suspension of bags above a product unit in said first predetermined position, said frame including means for automatically rotating each of said arms, with a bag suspended from each of said arms, above a product unit in said first predetermined position.

* * * * *